United States Patent [19]

Dogadko et al.

[11] Patent Number: 4,862,861

[45] Date of Patent: Sep. 5, 1989

[54] UNDER THE FLYWHEEL IGNITION SYSTEM

[75] Inventors: Peter Dogadko, Chicago; Gregry M. Remmers, Ingleside, both of Ill.

[73] Assignee: Outboard Marine Corporation, Waukegan, Ill.

[21] Appl. No.: 311,090

[22] Filed: Feb. 15, 1989

Related U.S. Application Data

[63] Continuation of Ser. No. 184,145, Apr. 21, 1988, abandoned.

[51] Int. Cl.[4] ..... F02P 1/00; F02P 11/00; F02P 3/12

[52] U.S. Cl. ..... 123/599; 123/631; 123/647

[58] Field of Search ..... 123/599, 631, 647

[56] References Cited

U.S. PATENT DOCUMENTS

| | | | |
|---|---|---|---|
| 4,224,917 | 9/1980 | Nakazawa et al. | 123/647 |
| 4,248,201 | 2/1981 | Tsutsui et al. | 123/647 |
| 4,333,442 | 6/1982 | Wolf | 123/599 |
| 4,406,271 | 9/1983 | Wolf | 123/599 |
| 4,407,256 | 10/1983 | Wolf | 123/599 |
| 4,418,677 | 12/1983 | Hofman | 123/599 |
| 4,491,121 | 1/1985 | Miura et al. | 123/631 |
| 4,603,664 | 8/1986 | Jackson | 123/599 |
| 4,628,891 | 12/1986 | Asai et al. | 123/599 |

*Primary Examiner*—Raymond A. Nelli

*Attorney, Agent, or Firm*—Welsh & Katz, Ltd.

[57] ABSTRACT

The present invention is directed to an improved capacitive discharge ignition system for a two cylinder internal combustion engine, such as an outboard marine engine. The system is adapted to be located beneath the flywheel of the engine and has overspeed and overheat protection. The overheat protection is of the type which is automatically deactivated after the overheat condition dissipates, but the deactivation will only occur when the operator slows the engine to a reduced speed before resuming normal operation.

32 Claims, 3 Drawing Sheets

UNDER THE FLYWHEEL IGNITION SYSTEM

This is a continuation of application Ser. No. 184,145 filed Apr. 21, 1988, now abandoned.

The present invention generally relates to capacitive discharge ignition systems, and more specifically relates to an improved capacitive discharge ignition system for a two cylinder engine, such as a marine engine and particularly an outboard marine engine.

Ignition systems for two cylinder engines of the type used in outboard marine engines that are typically within the range of about 20 to about 55 horsepower, are capacitive discharge ignition systems. Such systems utilize the engine flywheel by using magnets embedded within the flywheel and which pass in magnetic proximity with coils for the purpose of generating power for operating the engine and perhaps auxiliary equipment, and for triggering the ignition timing for the engine. In the past, the various coils were located under the flywheel in position to magnetically interact with the magnets, but the ignition circuitry was located in a black box that was generally mounted on the side of the engine and electrical leads extended to the various coils and to the spark plugs. While such an arrangement worked satisfactorily, there was always the possibility that the black box could be damaged because of its relative exposed location, and of course the electrical leads had to be connected to the coils beneath the flywheel and to the spark plugs, and had to be positioned so that they would not be exposed to damage.

The space beneath the flywheel was not large, and conventional coils have heretofore occupied nearly all of this space. In this regard, the flywheel typically has most of its weight located at its outer periphery, has a bridging portion extending from the periphery to the hub and the hub is connected to the crankshaft of the engine. The space that is available for receiving the various coils is located between the periphery and the hub and the interior surface of the outer periphery is generally parallel to the crankshaft and the magnets are embedded in this interior surface and adapted to magnetically interact with the coils that may be mounted on an armature plate or ignition plate assembly that is mounted on the engine. The ignition plate assembly is capable of limited rotational movement relative to the engine block, for the purpose of providing ignition timing adjustments in the manner that is well known in the art.

As previously alluded to, the space beneath the flywheel was not large, and there was generally a relatively large charge coil for charging the capacitor of the capacitive discharge ignition system, in addition to two coils for providing auxiliary power for powering lighting for the boat, the charging battery and the like. These coils have generally occupied approximately three quarters of the angular space beneath the flywheel, and the other quarter was occupied by the trigger coil that is used to provide the proper timing for the capacitive discharge ignition system.

While this arrangement functioned quite well, it was necessary to provide the black box containing the electrical circuitry for the ignition system at a location elsewhere on the engine and have electrical leads extending from the coils to the black box and then to the spark plugs, as has been described.

Accordingly, it is an object of the present invention to provide an improved ignition system for a two cylinder engine of the foregoing type wherein the circuitry of the ignition system is packaged in a single unit that can be mounted beneath the flywheel without sacrificing the desirable functional features that have been otherwise provided.

It is another object of the present invention to provide such an improved ignition system that has circuitry that provides overheat and overspeed protection for the engine, with the vast bulk of the circuitry contained within the single unit It is still another object of the present invention to provide the trigger coil as well as a power supply coil for powering the circuitry of the ignition system within the unit, except for the charging coils, thereby minimizing the number of leads and external connectors that are needed for the ignition system.

A more detailed object of the invention is to provide a unique and improved core and bobbin assembly as well as the trigger and power supply coils which provide the desired power characteristics for both the trigger and power supply signals.

These and other objects and advantages will become apparent upon reading the ensuing specification, while referring to the attached drawings, in which.

DETAILED DESCRIPTION

Broadly stated, the preferred embodiment of the present invention is directed to an improved capacitive discharge ignition system for a two cylinder internal combustion engine, such as an outboard marine engine. While the preferred embodiment is for a two cylinder engine, it is not limited to a two cylinder engine, and other embodiments that would be useful for engines having more than two cylinders is within the contemplation of the present invention.

The ignition system of the present invention provides overspeed and overheat protection to prevent damage to the engine in the event it experiences a runaway speed condition or becomes overheated.

The ignition system of the present invention is adapted to be contained in a modular unit that can be located beneath the flywheel of the engine, and the system includes a printed circuit board to which the vast bulk of the electrical components are mounted. The ignition system has a power supply coil for powering the ignition circuitry and a trigger coil for triggering the discharge of the capacitor for producing the sparking of the spark plugs. The power supply coil and trigger coil are positioned adjacent one another and are wound on a common bobbin structure and utilize a single core that is configured to provide the proper characteristics for the respective voltages that are needed for triggering the ignition system and for providing power for operating the circuitry of the ignition system.

The charging coil for charging the charge capacitor for the system is not provided in the modular unit, nor is the temperature switch for providing the overheat signal for limiting the speed of the engine if it has become overheated.

Figure 1:
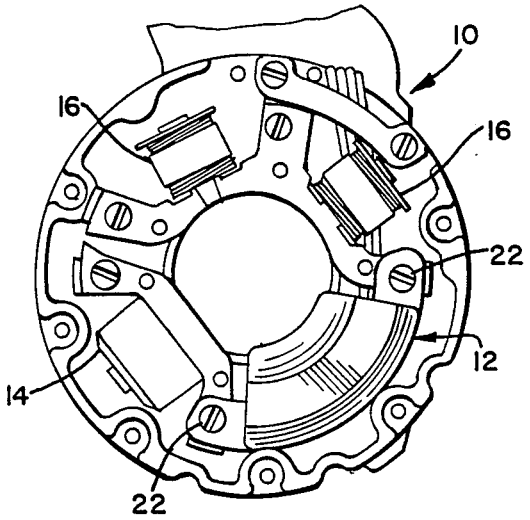
FIG. 1 is a top plan view of an ignition plate assembly and illustrating the auxiliary power coils, the charging coil and the unit comprising one embodiment of the present invention.
Figure 2:
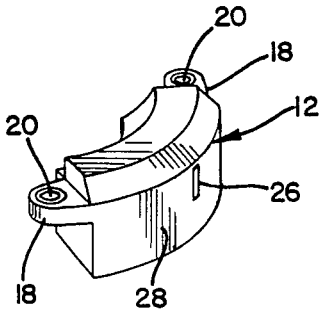
FIG. 2 is a perspective view of the unit comprising one embodiment of the present invention.

Turning now to the drawings, an ignition plate assembly, indicated generally at 10, is shown in FIG. 1, and includes the ignition system unit indicated generally at 12, embodying the present invention, a charging coil 14 for charging the charge capacitor of the present invention, and two coils 16 for providing auxiliary power for lights, battery charging and the like on a boat on which the motor may be used. The ignition system unit 12, as shown in FIGS. 1 and 2, includes a housing having extensions 18 with apertures 20 therein for mounting the unit 12 to the ignition plate assembly 10 with screws 22 or the like. The housing is preferably made of a plastic or plastic-like material, such as Rynite® made by DuPont. After the circuitry is assembled and placed within the housing, it is then filled with a potting compound, preferably a polyurethane or other suitable material, to seal the circuitry, protecting it from vibration, moisture and corrosive elements.

Figure 3:
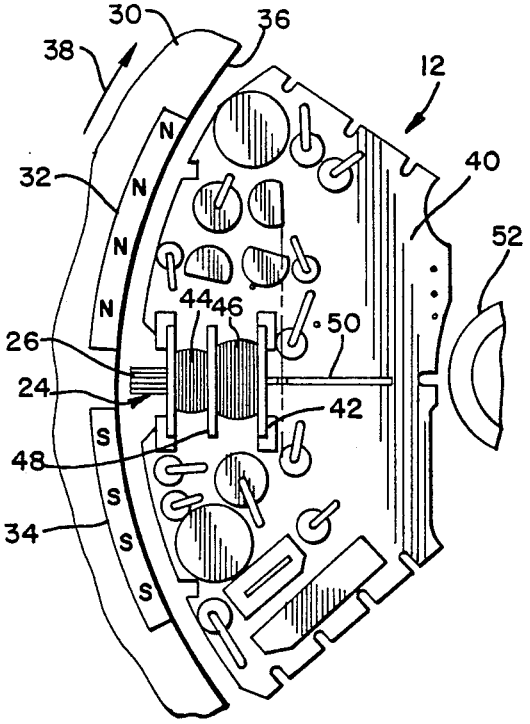
FIG. 3 is a top plan view of one embodiment of the present invention, shown with the protective enclosure and filling material removed, and shown with a portion of the flywheel of the engine.
Figure 4:
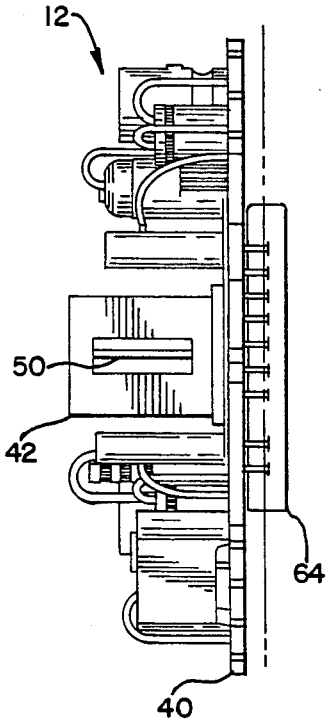
FIG. 4 is a side view of the structure shown in FIG. 3.

As is shown in FIGS. 2 and 3, a magnetically conductive core, indicated generally at 24, has its outer end 26 extending through the outer curved surface 28 of the housing so as to be in close proximity to a flywheel 30 which has magnet elements 32 and 34 embedded within the interior face 36 of the flywheel. For the two cylinder engine embodiment specifically described herein, the flywheel contains two sets of magnets, one set of which is shown in FIG. 3. The magnet element 32 has its front face comprising a north magnetic pole, while the element 34 has a front face comprising a south magnetic pole.

Another set of magnetic elements is provided but is not shown, and is diametrically opposite those shown in FIG. 3. The second set has the poles reversed, so that during rotation of the flywheel, there is an alternation of magnetic pole transitions as the sets of magnetic elements pass the core 24, so as to induce opposite going voltages in the coils that are wound around the core 24, as will be hereinafter described. Stated in other words, if the rotation of the flywheel is as shown by the arrow 38, the illustrated magnetic elements will provide a north-to-south pole transition, while the other set of magnetic elements will provide a south-to-north pole transition. The distance between the core end 26 and the surface of the magnetic elements as they pass the core end 26 is preferably about 0.015 inches.

Figure 5:
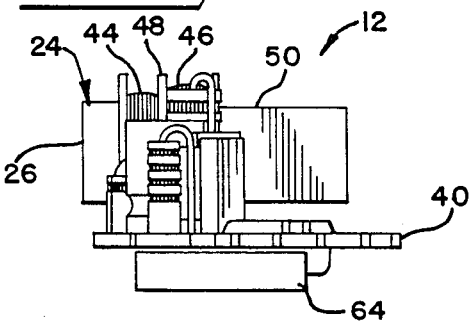
FIG. 5 is an end view of the structure shown in FIG. 3.

In accordance with an important aspect of the present invention, the ignition system has a printed circuit board 40 on which the electrical components are mounted and electrically connected. A plastic bobbin 42 is provided on which a power supply coil 44 for powering the circuitry of the ignition system is wound, as is a trigger coil 46 for triggering the ignition system. The core 24 is shown to comprise five laminations at the outer end 26 and these five laminations extend to the boundary portion 48 separating the two coils 44 and 46. The center lamination 50 is shortened vertically a small amount, as is illustrated in FIG. 5, and extends toward a hub 52 of the flywheel as shown in FIG. 3. The distance between the end of the center lamination and the hub 52 is approximately 0.25 inches, which is sufficiently close to complete the magnetic circuit to the hub and to the crankshaft to which the flywheel is attached. The configuration of the core and its spacial relationship to the magnets in the periphery of the flywheel and to the hub permit a magnetic circuit to be completed from the magnets, through the core, to the hub of the flywheel and to the engine crankshaft. The arrangement is different from prior cores which often completed the magnetic circuit in the core itself. The arrangement disclosed herein contributes to the efficient utilization of the available space inasmuch as the core is generally straight, slender and elongated.

Figure 6:
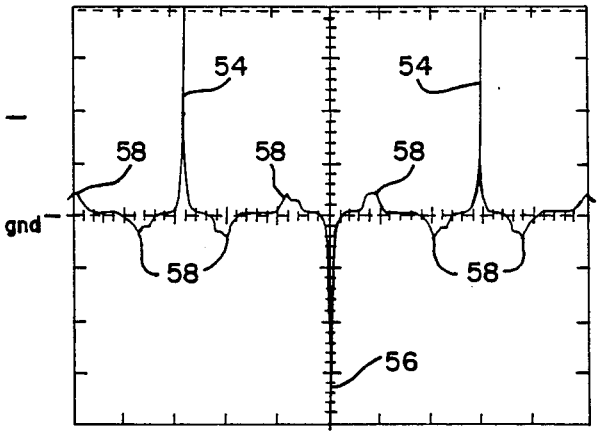
FIG. 6 is a graph illustrating the waveform of the voltage induced in the trigger coil of the present invention.
Figure 7:
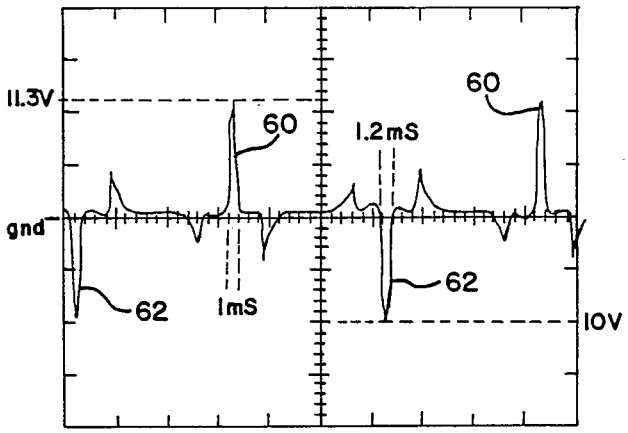
FIG. 7 is a graph illustrating the waveform of the voltage induced in the power supply coil of the present invention.

The effect of having five laminations of the core 24 extending through the power supply coil 44 and only one lamination extending through the trigger coil 46 is to provide narrow trigger pulses for triggering the discharge of the charge capacitor 72. This is shown in the waveform of FIG. 6 by the positive pulses 54 which alternate with the negative pulses 56, only one of the latter of which is shown in the drawing. The single laminate saturates sooner than the multiple laminates, and produces a sharper voltage pulse during pole to pole transitions. The narrow pulses are separated by smaller amplitude positive and negative maverick pulses which are produced when the leading and trailing edges of each magnetic element pass by the core 24. The large amplitude pulses 54 and 56 occur as a result of a transition between magnetic pole elements. The trigger coil is preferably approximately 650 turns of number 38 gauge wire. The broader width of the five laminations section results in the power supply coil 44 producing broader pulses 60 and 62, which produce more power for powering the circuitry of the present invention.

Figure 8:
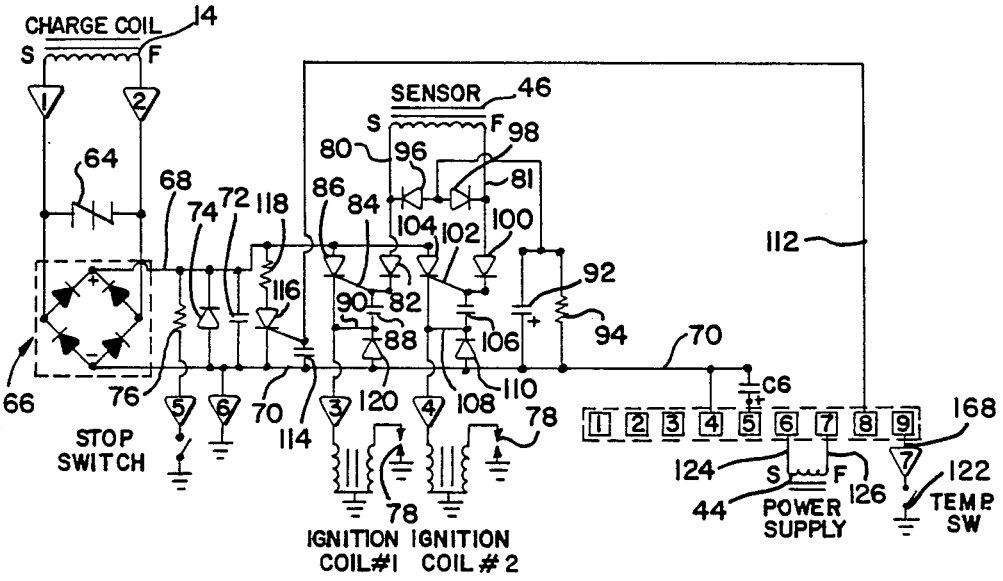
FIG. 8 is an electrical schematic diagram of a portion of the circuitry of the preferred embodiment of the present invention; and, FIG. 9 is an electrical schematic diagram of another portion of the circuitry of the preferred embodiment of the present invention.
Figure 9:
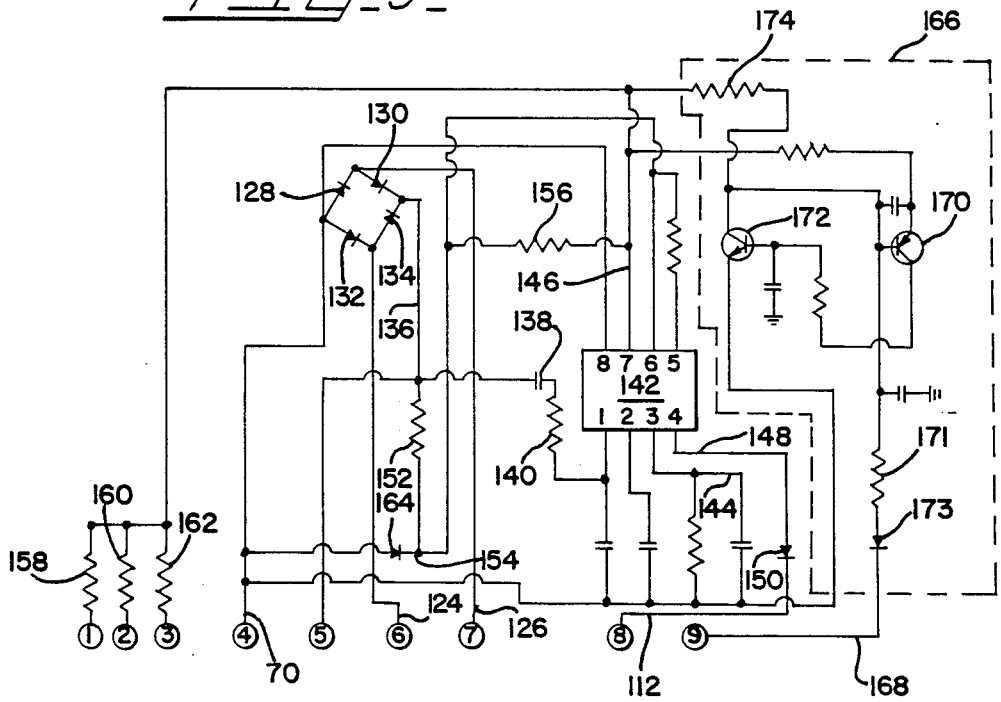

The circuitry of the preferred embodiment is conveniently separated into two portions, one of which is shown in FIG. 8 and other shown in FIG. 9. The circuitry of FIG. 8 is located on the printed circuit board 40, and the circuitry of FIG. 9 is located on a smaller printed circuit board 64 that is connected to the circuit board 40 by 9 connections identified by the numbered (1–9) square blocks in FIG. 8 and the numbered circles (1–9) in FIG. 9.

Turning now to the specific schematic circuitry illustrate in FIG. 8, the charging coil 14 has its opposite ends connected across a two terminal bidirectional switching means or Sidac 64 and across a full wave rectifying bridge 66, which has its positive terminal connected to line 68 and its negative terminal connected to ground line 70. The line 68 is connected to charging capacitor 72 for charging the same during operation. A diode 74 is provided for damping purposes and a resistor 76 connected to the charging capacitor 72 via line 68 is also connected to ground through a stop switch for turning the engine on and off. When the stop switch is closed, the capacitor 72 is discharged, and the engine will decelerate and stop.

As previously mentioned, the embodiment illustrated cylinder engine and has ignition coils #1 and #2, each of which is connected to a spark plug 78. The capacitor 72 is discharged through either one of the ignition coils at the appropriate time by operation of the trigger coil or sensor coil 46 in conjunction with associated triggering circuitry. The trigger coil 46 has one end connected to line 80, which is connected to diode 82, the cathode of which is connected via a line 84 to the gate of an SCR 86 and to a capacitor 88. Similarly, the other end of the trigger coil 46 is connected to line 81, which is connected to diode 100, the cathode of which is connected via a line 102 to the gate of an SCR 104 and to a capacitor 106. Capacitor 88 is connected by a line 90 to the cathode of SCR 86 and to diode 120, as well as to the ignition coil #1, while capacitor 106 is similarly connected by a line 108 to diode 110, the cathode of SCR 104 and to ignition coil #2.

During operation, as one or the other of the magnetic pole transitions occurs during rotation of the flywheel, the trigger coil 46 provides a positive voltage in either line 80 or line 81, and assuming it is line 80 by way of example, current passes through diode 82 to the gate of the SCR 86 to trigger it on. It then conducts current from the capacitor 72 through line 68, SCR 86 and line 90 to the ignition coil #1, producing a spark in the associated spark plug 78. The subsequently occurring opposite magnetic transition results in a spark being produced in the other spark plug. A biasing network comprised of capacitor 92, resistor 94, and diodes 96 and 98 operate to mask the maverick pulses previously described, so that the spark is produced by either spark plug at the desired point in time.

To control the speed of the engine in the event of an overspeed condition, the circuitry of FIG. 8, coupled with the circuitry of FIG. 9 operate to limit the speed to a lower predetermined level. While the sensing of an overspeed condition is performed by the circuitry of FIG. 9, the sensed condition produces an electrical signal that is used by the circuitry of FIG. 8. If an overspeed condition is detected, a high voltage level is applied on line 112 that is connected to a capacitor 114 and to the gate of an SCR 116, the latter of which is connected in series with a resistor 118 across line 68 and line 70. When current is applied to the gate of SCR 116, it is switched into conduction, which discharges the charging capacitor 72, thereby inhibiting sparking of either of the spark plugs 78. As soon as the speed is reduced below the critical value, the high voltage on line 112 is switched low, and the SCR 116 is switched open, thereby enabling normal operation, unless and until it returns to an overspeed condition.

To control the speed of the engine in the event of an overheat condition, the circuitry of FIG. 8 and FIG. 9 also cooperate to limit the speed of the engine. This is also accomplished by having a high voltage on line 112, which is produced when a temperature switch 122 is closed as a result of an excessive running temperature for the engine.

To produce the high voltage on line 112, the circuitry of FIG. 9 utilizes a frequency to voltage converter circuit, together with comparators that produce a high output voltage on line 112 that extends to the circuitry of FIG. 8. Referring to FIG. 8, the power supply coil 44 has its opposite ends connected to lines 124 and 126, which extend to (see FIG. 9) an unregulated diode bridge comprised of diodes 128 through 134, producing an output on line 136 that is applied through capacitor 138 and resistor 140 to input pin 1 of an integrated circuit 142, which is preferably a frequency to voltage converter circuit, model No. CS2907-D8, made by the Cherry Semiconductor Company, although other frequency to voltage converters can be used. The voltage level on line 136 has a ripple that is a function of the voltage induced in the power supply coil 44 and whose frequency is therefore proportional to the speed of the engine. The capacitor 138 differentiates this ripple voltage and produces pulses which ar applied to pin 1 of the integrated circuit 142. The frequency of the pulses in the voltage on pin 1 of the integrated circuit 142 is converted to an analog voltage on pin 3, so that output line 144 has a voltage that varies in direct proportion to the speed of the engine. A reference voltage is applied to pin 7 of the integrated circuit 142 by a line 146, and the circuit 142 compares the values of pins 3 and 7 and provides a high voltage on pin 4 and line 148 when the voltage on pin 3 exceeds that on pin 7. Line 148 is connected to diode 150 which is connected to line 112, and a high l voltage on line 112 operates to disable the ignition as previously described with respect to the circuitry of FIG. 8.

The power for the circuitry of FIG. 9 is provided by the diode bridge and line 136 has a voltage level of approximately 10 volts. Line 136 is connected to resistor 152 which is connected to line 154, which in turn is connected to ground line 70 through the Zener 164 and to pin 7 of the integrated circuit 142 through resistor 156 and line 148. The voltage level on line 154 is preferably approximately 5.6 volts. The voltage level on line 146 determines the speed at which the speed limiting operation occurs, and the speed at which the ignition is cut out is determined, in the absence of an overheat condition, by the value of one of the resistors 158, 160 or 162 one of which is selected by use of jumpers (not shown). The values of these resistors is determined to provide different maximum speed conditions for different sized engines that the ignition system may be installed in. Resistors 158, 160 and 162 are preferably chosen to provide ignition cutout speeds of 5200 r.p.m., 5800 r.p.m. and 6100 r.p.m., respectively.

The cutout of the ignition is also provided in the event of an overheat condition, and the circuitry indicated generally at 166 accomplishes this. This circuit operates to cutout the ignition when the temperature switch 122 (FIG. 8) closes, which pulls line 168 low. Line 168 is connected to the base of a transistor 170 via a resistor 171 and diode 173, and a low on line 168 switches transistor 170 into conduction, which then switches a transistor 172 into conduction. This has the effect of placing a resistor 174 in parallel with one of the resistors 158, 160 or 162, which changes the reference voltage on pin 7 of the integrated circuit 142 to a lower value. This results in the ignition being cut out at a lower speed, and is preferably at approximately 2500 r.p.m.

The overheat circuit 166 remains latched, in the sense that transistor 172 remains in conduction, until the overheat switch opens and the motor is slowed to a low speed of preferably approximately 700 to 900 r.p.m. This occurs as a result of the operator slowing the engine speed to this lower speed and the inability of the power supply coil 44 to supply sufficient power to power the circuitry of FIG. 9. When that happens, the transistors 172 and 170 unlatch, and the engine can then be controlled to increase its speed and it can exceed the 2500 r.p.m. operating speed if the overheat switch 122 is open. The 700 to 900 r.p.m. value for causing the circuitry of FIG. 9 to cease operating is primarily a function of the size and number of turns of the power supply coil 44, which is preferably about 300 turns of number 36 gauge wire. Removing turns of the wire would increase the speed at which the circuit would cease operating.

The 700 to 900 r.p.m. value is above the typical idling speed of the engine of approximately 600 r.p.m., so that the engine will still operate, and will not have to be restarted. A safety benefit is also obtained by the operation of the circuit. The circuitry 166 remains latched and controls the speed of the engine at not greater than 2500 r.p.m. speed even if the temperature switch 122 opens, which would occur when the overheat condition has dissipated. However, if the operator still has the throttle at a high speed setting, the engine will not automatically return to the high speed operation. The operator must return the speed to below the 700 to 900 r.p.m. speed to unlatch the circuit, at which time the operator can then adjust the speed to that which is desired without any "surprise".

From the foregoing, it should be appreciated that an improved ignition system has been described which provides desireable overspeed and overheat operating limits for the engine that protects the same from damage. The overheat protection has the desireable feature of automatically unlatching without shutting off the engine, but only when the operating speed is manually reduced to a low value. The entire ignition system is comprised of a relatively few number of components and is housed in a small self-contained unit that is placed under the flywheel of the engine. This has the effect of reducing the number of electrical leads and connectors and also provides a protected environment for the circuitry.

Although various embodiments of the invention have been shown and described in full herein, there is no intention to limit the invention to the details of such embodiments. On the contrary, it is the intention that the invention cover all of the various modifications, alternatives, substitutions and equivalents that may fall within the spirit and scope of the invention as set forth in the appended claims.

Various features of the present invention are set forth in the following claims.

What is claimed is:

1. An ignition system for an internal combustion engine, such as an outboard engine for a powering a watercraft, the engine being of the type which has rotating flywheel located above and attached to the crankshaft of the engine, the flywheel containing two magnetic means, each having opposite magnetic pole interior surfaces adjacent one another in the direction of rotation, said two magnetic means together generating at least one magnetic north-to-south transition and at least one magnetic south-to-north transition relative to a reference location during each rotation of the flywheel, the system comprising:

an ignition capacitor means;

a printed circuit board being mounted to said engine beneath and adjacent the flywheel, said printed circuit board having nearly all of said means of the system mounted and electrically connected thereto;

means for charging said ignition capacitor means;

an ignition capacitor discharge means connected to discharge said ignition capacitor means in response to receiving a trigger pulse applied thereto; and, trigger pulse generating means for producing trigger pulses in synchronism with the engine speed, said trigger pulse generating means being adapted to provide pulses that define a timing characteristic for discharging said ignition capacitor means;

said trigger pulse generating means comprising at least one detecting means adapted to produce trigger pulses in response to magnetic pole-to-pole transitions passing in close proximity to said detecting means during rotation of the flywheel.

2. A system as defined in claim 1 wherein each of said detecting means comprises a sensing coil adapted to sense magnetic pole-to-pole transitions during rotation of the flywheel.

3. A system as defined in claim 2 further including a power supply coil located adjacent the sensing coil for generating power in response to magnetic pole-to-pole transitions during rotation of the flywheel, said power supply coil being connected to transmit the power to the system for operating the same.

4. A system as defined in claim 3 wherein said sensing and power supply coils are located adjacent one another and have a magnetically conductive core that extends through both of said coils.

5. A system as defined in claim 3 further including a bobbin means upon which each of said sensing and power supply coils are wound, said system including a magnetic core extending through both of said coils and providing a magnetic conducting path from the magnetic means to the crankshaft of the engine.

6. A system as defined in claim 5 wherein said power supply coil is located adjacent said sensing coil and said power supply coil is nearer said magnetic means, said core having a larger cross sectional area within said power supply coil and having a reduced cross sectional area within said sensing coil and extending from said sensing coil to a point near the crankshaft of the engine.

7. A system as defined in claim 6 wherein the spacing between said core and the magnetic means is approximately 0.015 inches.

8. A system as defined in claim 7 wherein said core comprises multiple laminations within said power supply coil and a fewer number of laminations within said sensing coil.

9. A system as defined in claim 8 wherein only one of the multiple laminations extends through said sensing coil.

10. An ignition system for an internal combustion engine, such as an outboard engine for a powering a watercraft, the engine being of the type which has a rotating flywheel located above and attached to the crankshaft of the engine, the flywheel containing at least two magnetic means, each having opposite magnetic pole interior surfaces adjacent one another in the direction of rotation, said two magnetic means together generating at least one magnetic north-to-south transition and at least one magnetic south-to-north transition relative to a reference location during each rotation of the flywheel, the system comprising:

first circuit means, comprising:

(a) an ignition capacitor means;

(b) an ignition capacitor discharge means connected to discharge said ignition capacitor means in response to receiving a trigger pulse applied thereto;

(c) trigger pulse generating means for producing trigger pulses in synchronism with the engine speed, said trigger pulse generating means being adapted to provide pulses that define a timing characteristic for discharging said ignition capacitor means;

(d) said trigger pulse generating means comprising at least one detecting means adapted to produce trigger pulses in response to magnetic pole to pole transitions passing in close proximity to said detecting means during rotation of the flywheel;

(e) means for producing an engine operating speed signal indicative of the speed of the engine;

second circuit means, comprising:

(a) means for disabling the ignition capacitor charging means in response to an ignition capacitor disabling signal being received;

(b) means for intermittently producing an ignition capacitor disabling signal to maintain the operating speed below a predetermined speed in response to an engine temperature signal being produced in response to the engine temperature exceeding an upper predetermined sensed level and also in response to an engine speed signal indicating an operating speed exceeding an upper predetermined level being produced;

(c) power pulse generating means for producing pulses in response to magnetic pole to pole transitions passing in close proximity thereto during rotation of the flywheel, said power generating means providing power for operating said second circuit means; and, means connected to said first circuit means for charging said ignition capacitor means.

11. A system as defined in claim 10 further including a printed circuit board operatively connected to said engine beneath and adjacent the flywheel, said printed circuit board having said first and second circuit means mounted thereon.

12. A system as defined in claim 11 wherein said trigger pulse generating means and said power pulse generating means each comprising at least one coil means mounted to said printed circuit board.

13. A system as defined in claim 12 wherein said trigger pulse coil means and said power pulse coil means are mounted adjacent one another on said printed circuit board, the system further including a ferromagnetic core element that extends from a location closely adjacent the magnet means, through both of said coil means to a location adjacent the flywheel, said magnet means core, flywheel and crankshaft defining a magnetic circuit.

14. A system as defined in claim 13 wherein said power pulse coil means is located closer to said magnet means than said trigger coil means, and said core has an increased cross-sectional area from its end adjacent said magnet means through the power pulse coil means, and a reduced cross-sectional area through the trigger pulse coil means.

15. A system as defined in claim 13 wherein the portion of said core that extends through the power generating coil means has a cross-sectional area that is approximately five times greater than the portion of said core that extends through the trigger coil means.

16. A system as defined in claim 10 wherein said predetermined speed is about 2500 r.p.m.

17. A system as defined in claim 10 wherein said upper level is within the range of about 5200 to about 6100 r.p.m.

18. An ignition system for an internal combustion engine, such as an outboard engine for a powering a watercraft, the engine being of the type which has a rotating flywheel located above and attached to the crankshaft of the engine, the engine having an ignition plate assembly beneath the flywheel and containing various coil means for interacting with magnets for producing pulses for use by the ignition system, the flywheel containing at least two magnet means, each having opposite magnetic pole interior surfaces adjacent one another in the direction of rotation, said two magnet means together generating at least one magnetic north-to-south transition and at least one magnetic south-to-north transition relative to a reference location during each rotation of the flywheel, the system comprising:

circuit means, comprising:

(a) a printed circuit board means mounted on the ignition plate assembly of the engine;

(b) an ignition capacitor means;

(c) an ignition capacitor discharge means connected to discharge said ignition capacitor means in response to receiving a trigger pulse applied thereto;

(d) trigger pulse generating means for producing trigger pulses in synchronism with the engine speed, and comprising at least one coil means adapted to produce trigger pulses in response to magnetic pole to pole transitions passing in close proximity thereto during rotation of the flywheel;

(e) power pulse generating means for producing pulses, and comprising at least one coil means adapted to produce power pulses in response to magnetic pole to pole transitions passing in close proximity thereto during rotation of the flywheel, said power generating means providing power for operating said circuit means;

(f) said trigger pulse coil means and said power pulse coil means being mounted adjacent one another on said printed circuit board, the system further including a ferromagnetic core element that extends from a location closely adjacent the magnet means, through both of said coil means to a location adjacent the center of the flywheel; and, means connected to said circuit means for charging said ignition capacitor means.

19. A system as defined in claim 18 wherein said circuit means further includes supplemental circuit means, comprising:

means for producing an engine operating speed signal indicative of the speed of the engine;

means for disabling the ignition capacitor charging means in response to an ignition capacitor disabling signal being received; and, means for intermittently producing an ignition capacitor disabling signal for maintaining the engine within a safe operating speed level in response to an engine temperature signal being produced in response to the engine temperature exceeding an upper predetermined sensed level and also in response to an engine speed signal indicating an operating speed exceeding an upper predetermined level being produced.

20. A system as defined in claim 18 wherein said trigger pulse and power pulse coil means are wound on a common bobbin means adjacent one another, said bobbin means being attached to said circuit board means, said core being secured to said bobbin means so as to extend through both of said coil means, said core having a generally rectangular side profile and an increased cross-sectional area in the vicinity of said power coil means and a smaller cross-sectional area in the vicinity of said trigger coil means.

21. A system as defined in claim 19 wherein said power pulse generating means is configured to provide power for operating said supplemental circuit means when the engine is operating above a predetermined above-idle speed, and is incapable of providing sufficient power for operating said supplemental circuit means below said predetermined above idle-speed, thereby incapacitating said circuit means below said supplemental predetermined above-idle speed.

22. A system as defined in claim 21 wherein said predetermined above-idle speed is in excess of the nominal idling speed of the engine.

23. A system as defined in claim 22 wherein said predetermined above-idle speed is within the range of about 700 to about 900 r.p.m.

24. An ignition system for an internal combustion engine, such as an outboard engine for a powering a watercraft, the engine being of the type which has a rotating flywheel located above and attached to the crankshaft of the engine, the flywheel containing at least two magnetic means, each having opposite magnetic pole interior surfaces adjacent one another in the direction of rotation, said two magnetic means together generating at least one magnetic north-to-south transition and at least one magnetic south-to-north transition relative to a reference location during each rotation of the flywheel, the system comprising:

circuit means, said circuit means including:

(a) an ignition capacitor means;

(b) an ignition capacitor discharge means connected to discharge said ignition capacitor means in response to receiving a trigger pulse applied thereto;

(c) trigger pulse generating means for producing trigger pulses in synchronism with the engine speed, said trigger pulse generating means being adapted to provide pulses that define a timing characteristic for discharging said ignition capacitor means;

(d) said trigger pulse generating means comprising at least one detecting means adapted to produce trigger pulses in response to magnetic pole to pole transitions passing in close proximity to said detecting means during rotation of the flywheel;

(e) means for producing an engine operating speed signal indicative of the speed of the engine;

(f) means for disabling the ignition capacitor charging means in response to an ignition capacitor disabling signal being received;

(g) means for intermittently producing an ignition capacitor disabling signal to maintain the operating speed below a first predetermined speed in response to an engine temperature signal being produced in response to the engine temperature exceeding an upper predetermined sensed level, and also in response to an engine speed signal indicating an operating speed exceeding a second predetermined speed being produced, said disabling signal producing means remaining operative to intermittently produce said signal even subsequently of the engine temperature being reduced below said upper predetermined sensed level, until the engine is slowed below a third predetermined speed;

(h) power pulse generating means for producing pulses in response to magnetic pole-to-pole transitions passing in close proximity thereto during rotation of the flywheel, said power pulse generating means being configured to provide power for operating said disabling signal producing means of said circuit means when the engine is operating above said third predetermined speed, and is incapable of providing sufficient power for operating said disabling signal producing means below said third predetermined speed, thereby incapacitating the same below said third predetermined speed; and, means connected to said circuit means for charging said ignition capacitor means.

25. A system as defined in claim 24 wherein said first predetermined speed is about 2500 r.p.m., said second predetermined speed is within the range of about 5200 to about 6100 r.p.m., and said third predetermined speed is within the range of about 700 to about 900 r.p.m.

26. Apparatus as defined in claim 1 further including:

means for producing an engine operating speed signal indicative of the speed of the engine;

means for disabling the ignition capacitor charging means in response to an ignition capacitor disabling signal being received; and, means for producing an ignition capacitor disabling signal in response to an engine temperature signal being produced in response to the engine temperature exceeding an upper predetermined sensed level and also in response to an engine speed signal indicating an operating speed exceeding an upper predetermined level being produced.

27. An ignition system for an internal combustion engine, such as an outboard engine for a powering a watercraft, the engine being of the type which has a rotating flywheel located above and attached to the crankshaft of the engine, the flywheel containing two magnetic means, each having opposite magnetic pole interior surfaces adjacent one another in the direction of rotation, said two magnetic means together generating at least one magnetic north-to-south transition and at least one magnetic south-to-north transition relative to a reference location during each rotation of the flywheel, he system comprising:

an ignition capacitor means;

a printing circuit board being mounted to said engine beneath and adjacent the flywheel, said printed circuit board having nearly all of said means of the system mounted and electrically connected thereto;

means for charging said ignition capacitor means;

an ignition capacitor discharge means connected to discharge said ignition capacitor means in response to receiving a trigger pulse applied thereto;

pulses generating means for producing trigger pulses in synchronism with the engine speed, said pulse generating means being adapted to provide pulses that define a timing characteristic for discharging said ignition capacitor means;

said pulse generating means comprising at least a sensing coil wound around a magnetically conductive core that extends from a point in close proximity to said flywheel to produce trigger pulses in response to magnetic-pole-to-pole transitions occurring during rotation of the flywheel, and defining a magnetic circuit that extends from said magnets through said core to the crankshaft of the engine.

28. A system as defined in claim 27 wherein said pulses generating means includes a power supply coil for generating power in response to magnetic pole-to-pole transitions during rotation of the flywheel, said power supply coil being connected to transmit the power to the system for operating the same.

29. A system as defined in claim 28 wherein said sensing and power supply coils are located adjacent one another and said magnetically conductive core extends through both of said coils.

30. A system as defined in claim 29 further including a bobbin means upon which each of said sensing and power supply coils are wound, said system including said magnetically conductive core extending through both of said coils and providing said magnetic conducting path from the magnetic means to the crankshaft of the engine.

31. A system as defined in claim 30 wherein said core comprises multiple laminations within said power supply coil and a fewer number of laminations within said sensing coil.

32. A system as defined in claim 31 wherein only one of the multiple laminations extends through said sensing coil.

* * * * *

UNITED STATES PATENT AND TRADEMARK OFFICE

CERTIFICATE OF CORRECTION

PATENT NO. : 4,862,861

DATED : September 5, 1989

INVENTOR(S) : Dogadko et al.

It is certified that error appears in the above-identified patent and that said Letters Patent is hereby corrected as shown below:

Column 4, lines 55-56, change "illustrate" to --illustrated--.

Column 5, lines 1-2, change "illustrated cylinder" to --illustrated is a two cylinder--.

Column 6, line 10, change "ar" to --are--.

Column 6, line 21, change "high l voltage" to --high voltage--.

Column 7, line 50, change "has rotating" to --has a rotating--.

Column 12, line 51, change "he" to --the--.

Column 12, line 53, change "printing" to --printed--.

Column 12, line 63, change "pulses" to --pulse--.

Column 13, line 9, change "pulses" to --pulse--.

Signed and Sealed this

Eleventh Day of September, 1990

*Attest:*

HARRY F. MANBECK, JR.

*Attesting Officer*

*Commissioner of Patents and Trademarks*